US007398048B2

(12) United States Patent
Tomatsu

(10) Patent No.: US 7,398,048 B2
(45) Date of Patent: Jul. 8, 2008

(54) IMAGE FORMING APPARATUS

(75) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 328 days.

(21) Appl. No.: 11/362,713

(22) Filed: Feb. 28, 2006

(65) Prior Publication Data

US 2006/0193666 A1 Aug. 31, 2006

(30) Foreign Application Priority Data

Feb. 28, 2005 (JP) ..... 2005-055084

(51) Int. Cl.
*G03G 15/00* (2006.01)

(52) U.S. Cl. ..... 399/401; 399/405; 400/691; 400/692; 400/693; 271/65; 271/291; 271/298; 271/301

(58) Field of Classification Search ..... 399/401, 399/405; 400/691, 692, 693; 271/65, 291, 271/298, 301

See application file for complete search history.

(56) References Cited

U.S. PATENT DOCUMENTS

| | | | |
|---|---|---|---|
| 6,553,207 | B2 | 4/2003 | Tsusaka et al. |
| 2002/0039508 | A1 | 4/2002 | Tsusaka et al. |

FOREIGN PATENT DOCUMENTS

| | | | |
|---|---|---|---|
| JP | 59092861 | | 5/1984 |
| JP | 61-88956 | U | 6/1986 |
| JP | 6-001515 | A | 1/1994 |
| JP | 7-146593 | A | 6/1995 |
| JP | 2002-003048 | A | 1/2002 |
| JP | 2002-012355 | A | 1/2002 |
| JP | 2002-104707 | A | 4/2002 |
| JP | 2002104707 | | 4/2002 |
| JP | 2004-075305 | A | 3/2004 |

OTHER PUBLICATIONS

JP Office Action dtd Nov. 13, 2007, JP Appln. 2005-055084.
JP Office Action dtd Apr. 1, 2008, JP Appln. 2005-055084.

*Primary Examiner*—Judy Nguyen
*Assistant Examiner*—Andy L Pham
(74) *Attorney, Agent, or Firm*—Banner & Witcoff, Ltd.

(57) ABSTRACT

An image forming apparatus including: a first driven roller that forms a first nip portion with a driving roller; a second driven roller that forms a second nip portion with the driving roller at a downstream side of the first nip portion; a first transfer passage into which the sheet passed through the first nip portion and sent from the second nip portion is transferred by a forward rotation of the driving roller; a second transfer passage into which the sheet passed through the first nip portion is transferred by the forward rotation of the driving roller without passing through the second nip portion; and a third transfer passage into which the sheet is transferred by a reverse rotation of the driving roller after a rear end of the sheet has passed through the first nip portion by the forward rotation of the driving roller.

8 Claims, 11 Drawing Sheets

IMAGE FORMING APPARATUS

CROSS REFERENCE TO RELATED APPLICATION

This application claims priority from Japanese Patent Application No. 2005-055084, filed on Feb. 28, 2005, the entire subject matter of which is incorporated herein by reference.

TECHNICAL FIELD

Aspects of the present invention relate to an image forming apparatus.

BACKGROUND

In an image forming apparatus, such as a laser printer, a known paper discharge method is used when one surface of paper (sheet) is printed. The method is capable of carrying out a face-down paper discharging operation in which the paper is discharged with a printed surface facing downward, and a face-up paper discharging operation in which the paper is discharged with a printed surface facing upward. This method is configured so that how to discharge the paper can be selectively determined depending upon the material and sizes of the paper, An image forming method is also known having the double face printing function of forming an image on both surfaces of paper in addition to the above-mentioned function.

There is an apparatus as an example of such an image forming apparatus disclosed in JP-A-2002-104707. In order to carry out a face-down paper discharging operation after an upper surface of paper 100 is printed as shown in FIG. 11, the paper 100 is sent from paper fixing and discharging rollers 102, on which the paper is provided in a fixing unit 101, to upper paper discharging rollers 103 provided in an upper portion of an apparatus body, and the paper 100 is discharged with a printed surface thereof directed downward onto a paper discharging tray 104 on an upper surface of the apparatus body. In order to carry out a face-up paper discharging operation, a rear-side cover 105 in a rear wall of the apparatus body is opened, and the paper 100 is sent rearward from the paper fixing and discharging rollers 102, the paper being then discharged with the printed surface directed upward onto the opened rear cover 105. In order to carry out a double face printing operation, the paper 100 the printing of one surface of which has been completed is once sent from the paper fixing and discharging rollers 102 to the upper paper discharging rollers 103, and the upper paper discharging rollers 103 are reversely rotated before a rear end of the paper 100 passes the upper paper discharging rollers 103, so that the rear end of the paper 100 is sent out to a re-transfer passage 106 provided so as to extend from an inner side of the rear-side cover 105 toward a front portion of the apparatus, the other surface of the paper 100 being then printed

SUMMARY

When the length of the transfer passage between the paper fixing and discharging rollers 102 and the upper paper discharging rollers 103 becomes larger than that of the paper 100 due to design reasons in this structure, it is necessary that paper transfer rollers 107 be additionally provided in an intermediate position between the paper fixing and discharging rollers 102 and the upper paper discharging rollers 103. As a result, a mechanism for driving these added rollers 107 needs to be added, and this causes the construction of the apparatus to be complicated, the dimensions thereof to be increased, and the manufacturing cost to be increased.

The present invention provides an image forming apparatus capable of sending sheets selectively to a plurality of transfer passages while preventing the complication of the apparatus.

According to an aspect of the invention, there is provided an image forming apparatus including: an image forming unit that forms an image on a sheet; a driving roller that is provided on a downstream side of the image forming unit and rotates in forward and reverse directions; a first driven roller that is driven to rotate and forms a first nip portion in cooperation with the driving roller; a second driven roller that is driven to rotate and forms a second nip portion in cooperation with the driving roller, the second driven roller being provided on a downstream side of the first nip portion; a first transfer passage into which the sheet passed through the first nip portion and sent from the second nip portion is transferred by a forward rotation of the driving roller; a second transfer passage into which the sheet passed through the first nip portion is transferred by the forward rotation of the driving roller without passing through the second nip portion; and a third transfer passage into which the sheet passed through the first nip portion and nipped at the second nip portion is transferred by a reverse rotation of the driving roller after a rear end of the sheet has passed through the first nip portion by the forward rotation of the driving roller.

Accordingly, the sheet can be transferred selectively to three transfer passages by one driving roller and two driven rollers. This enables the purpose to be met by one roller driving mechanism, and the complication of the apparatus to be prevented. Therefore, an increase in the dimensions of the apparatus can be prevented, and an increase in the cost can be suppressed.

BRIEF DESCRIPTION OF THE DRAWINGS

Illustrative aspects of the invention maybe more readily described with reference to the accompanying drawings.

DETAILED DESCRIPTION

An aspect the present invention will now be described with reference to FIG. 1 to FIG. 10.

Figure 1:
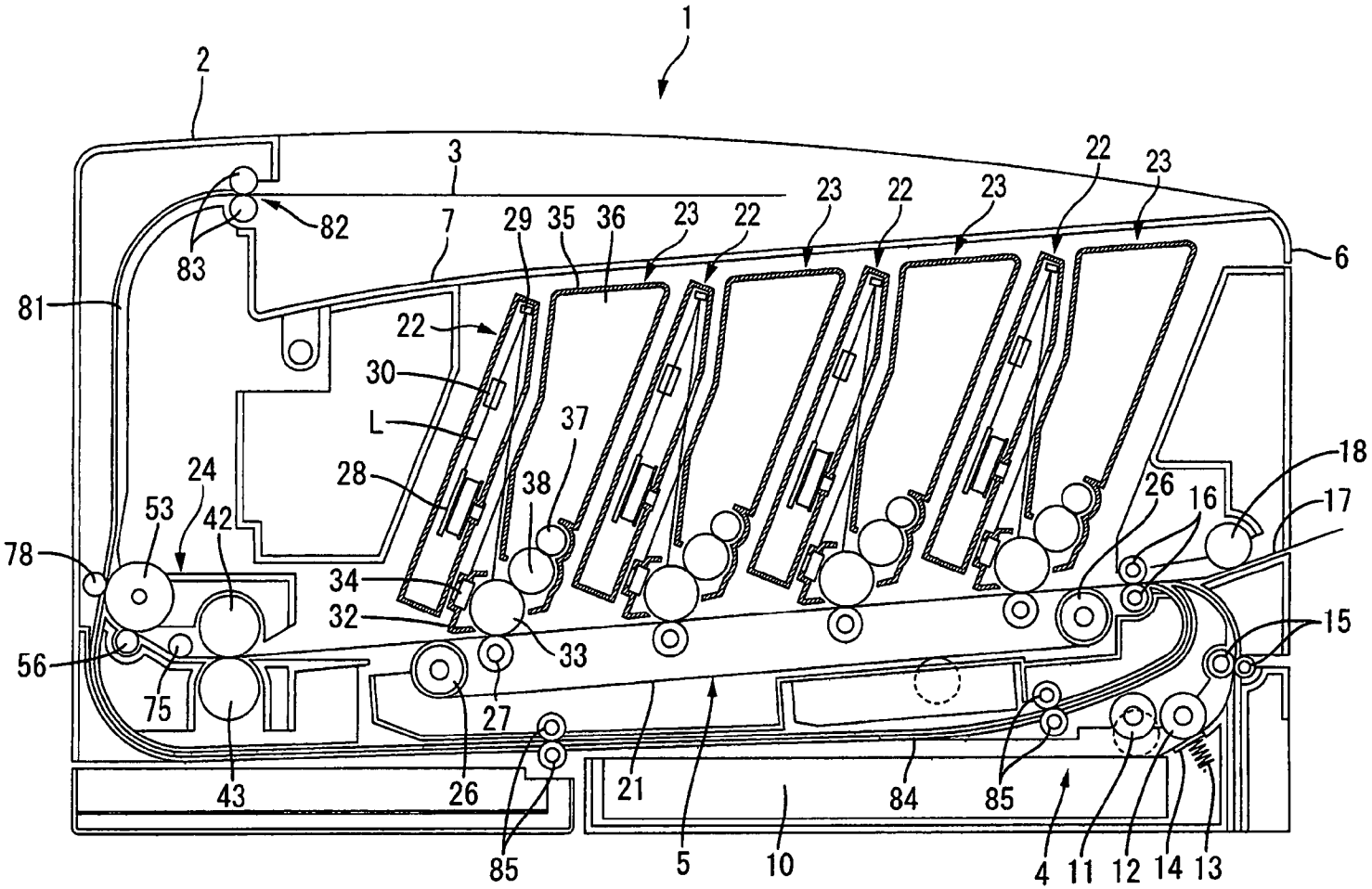
FIG. 1 is a sectioned side view showing schematic construction of a laser printer according to an aspect of the present invention.

(1) General Construction of Laser Printer:

FIG. 1 is a sectioned side view showing the schematic construction of a laser printer 1 as an image forming apparatus according an aspect of the present invention. This laser printer 1 is a direct tandem type color laser printer provided with four photosensitive drums 33 as four image carriers corresponding to each of colors including black, cyan, magenta and yellow. Concerning a front-rear direction referred to in the following description, the right side of FIG. 1 and the left side of the FIG. 3 to FIG. 10 shall be the front side.

As shown in FIG. 1, the laser printer 1 is provided with a body casing 2 that is a box type as a whole, in the interior of which a feeder member 4 for feeding paper 3 as a sheet, and an image forming unit 5 for forming an image on the fed paper 3, and the like are provided. On an upper surface of the body casing 2, an upper surface cover 6 which can be opened and closed is provided. When the upper surface cover 6 is opened, the replacing of a process cartridge 23 in the body casing 2 can be carried out. The upper surface of the upper surface cover 6 is provided thereon with a paper discharge tray 7 on which the paper 3 the printing of which has been finished is stacked.

(2) Feeder Member:

The feeder member 4 is provided with a paper feed tray 10 detachably attached to a bottom portion of the interior of the body casing 2, a pickup roller 11 and a paper feed roller 12 arranged side by side in the front-rear direction at an upper side of an upper end of the paper feed tray 10, a separating pad 14 brought into pressure contact with the paper feed roller 12 by an urging force of a spring 13, a pair of paper powder removing rollers 15 provided above a front side of the paper feed roller 12, and a pair of registration rollers 16 provided above a rear side of the paper powder removing rollers 15.

On a bottom surface of the paper feed tray 10, an inclinable paper urging plate (not shown) is provided so that the urging plate raises a front end side of the paper 3, and the paper 3 loaded in the uppermost position of the paper feed tray 10 is pressed toward the pickup roller 11 by an urging force of the urging plate, the transferring of the paper toward a clearance between the paper feed roller 12 and separating pad 14 being started owing to the rotation of the pickup roller 11. When the paper 3 is held between the feed paper roller 12 and separation pad 14, the paper leaves this position one by one, and is sent in the diagonally upward direction, one piece of the paper being subjected to the removal of paper powder by the operation of a pair of the paper powder removing rollers 15. The paper is there after transferred to the registration rollers 16. The body casing 2 is provided in a front surface thereof with a feed paper port 17 for feeding paper 3 by hand into the body casing. The paper 3 fed from this port is transferred to the registration rollers 16 as well by a manual paper feed roller 18. The registration roller 16 is adapted to correct the diagonal travel of the paper 3, and then send the paper 3 onto a transfer belt 21 at a predetermined timing.

(3) Image Formation Unit:

The image forming unit 5 is provided with the transfer belt 21, a scanner 22, a process cartridge 23, a fixing unit 24 and the like.

(a) Transfer Belt:

The transfer belt 21 is provided between a pair of belt support rollers 26 arranged in a longitudinally spaced manner so that the transfer belt is inclined at a rear end portion thereof in a slightly lowering manner. The transfer belt is circulatingly moved in accordance with the rotation of the rear side belt support roller 26. On the inner side of the transfer belt 21, four transfer rollers 27, which are disposed so as to be opposed to corresponding photosensitive drums 33 provided in the process cartridges 23 which will be described later, are arranged side by side in the longitudinal direction at predetermined intervals. The transfer belt 21 is thus held between the photosensitive drums 33 and transfer rolls 27 opposed thereto.

(b) Scanner Members:

Above the transfer belt 21, four scanners 22 as exposure units are arranged longitudinally at predetermined intervals. Each of these scanners 22 include a polygon mirror 28 adapted to reflect a laser beam L, which is generated by a laser diode (not shown), in such a manner that the direction of the laser beam L is changed in order along a predetermined surface, a reflecting mirror 29 adapted to reflect the laser beam L, which is reflected on the polygon mirror 28, toward the photosensitive drum 33 of the process cartridge 23, an fθ lens 30 provided in an optical path of the laser beam L, and the like.

(c) Process Cartridge:

Four process cartridges 23 are provided corresponding to each of various colors including magenta, yellow, cyan and black, and detachably attached to the portions of front sides of the scanners 22 which are above the transfer belt 21. The process cartridges 23 are provided at lower portions of cartridge frames 32 with the photosensitive drums 33 and Scolotron type chargers 34, and at upper portions thereof with developing cartridges 35 as developing units.

Each photosensitive drum 33 has a cylindrical shape, and a metal drum shaft thereof is provided, with which a metal positive charging photosensitive layer the outermost surface of which is made of polycarbonate and the like, is covered. This photosensitive drum 33 is rotated by an input of power from a motor (not shown).

In the rear diagonally upper side of the photosensitive drum 33, the Scolotron type charger 34 is provided so that the Scolotron type charger 34 is opposed to the photosensitive drum 33 and does not contact therewith. This Scolotron type charger 34 generates corona discharge from a charging wire, such a tungsten wire and the like to charge the surface of the photosensitive drum 33 positively and uniformly.

The cartridge 35 has a box type shape opened at a lower side thereof, and attached detachably to the cartridge frame 32. In an upper portion of the interior of this developing cartridge 35, a toner storage chamber 36 is provided which is filled with a toner of a positively charging non-magnetic mono-component. A polymeric toner obtained by copolymerizing through the suspension polymerization of polymeric monomers, for example, a styrene-based monomer of styrene and the like, an acrylic acid, alkyl (C1 to C4) acrylate, alkyl (C1 to C4) methacrylate, and a polymeric monomers and the like are used as this toner. Such toners have substantially spherical shape and a very high fluidity, and capable of attaining the forming of a high-quality image. In a lower side portion of the interior of the toner storage chamber 36, a feed roller 37, a developing roller 38, a layer thickness restriction blade (not shown) and the like are provided.

The feed roller 37 is supported rotatably in the developing cartridge 35, and rotated by an input of power from a motor (not shown). This feed roller 37 is obtained by covering a metallic roller shaft thereof with a roller made of a conductive foaming agent.

The developing roller 38 is supported rotatably in the developing cartridge 35 in a compressed state with respect to the feed roller 37 in a diagonally rear lower position of the feed roller 37. The developing roller 38 is in contact with the photosensitive drum 33 in an opposed state with the developing cartridge 35 fixed to the cartridge frame 32. This developing roller 38 is obtained by covering the metallic roller shaft thereof with the roller body made of a conductive rubber material.

This developing roller 38 is rotated by an input of power from a motor (not shown).

The thickness restriction blade is provided at a front end portion of a metal plate spring with a pressure portion made of an insulating silicone rubber. This thickness restriction blade is supported above the developing roller, and the pressure portion is brought into pressure contact with the developing roller 38 by an elastic force of the plate spring.

The toner discharged from the toner storage chamber 36 is supplied to the developing roller 38 owing to the rotation of the feed roller 37. During this time, the toner is positively friction charged between the feed roller 37 and developing roller 38. The toner supplied onto the developing roller 38 is moved into a clearance between the pressure portion of the thickness restriction blade and developing roller in accordance with the rotation of the developing roller 38, and supported as a thin layer of a predetermined thickness on the developing roller 38.

After an outer surface of the photosensitive drum 33 is charged uniformly by the Scolotron type charger 34 in accordance with the rotation of the same drum 33, the outer surface of the same drum 33 is then exposed to high-speed scanning of a laser beam L from the scanner 22, so that an electrostatic latent image corresponding to an image to be formed on the paper 3 is formed when, owing to the rotation of the developing roller 38, the toner supported on the same roller 38 and positively charged is brought into contact with the photosensitive drum 33 in an opposed state thereto, the toner is supplied to the electrostatic latent image formed on the outer surface of the photosensitive drum 33. As a result, the electrostatic latent image on the photosensitive drum 33 is turned into a visible image, so that a toner image based on the reverse development is supported on the photosensitive drum 33.

The toner image supported on the surface of the photosensitive drum 33 is then transferred to the paper 3 while the paper 3 transferred by the transfer belt 21 passes a transfer position between the photosensitive drum 33 and transfer roller 27 by a transfer bias voltage applied to the transfer roller 27. The paper 3 to which toner images corresponding to various colors were transferred is then sent to the fixing unit 24. In the fixing unit 24, the paper 3 is heated, and the toner images are thermally fixed to the paper. The paper 3 to which the toner images were thermally fixed are sent along anyone of three transfer passages R1 to R3 as will be described later, and discharged or re-transferred to the image forming unit 5.

Figure 2:
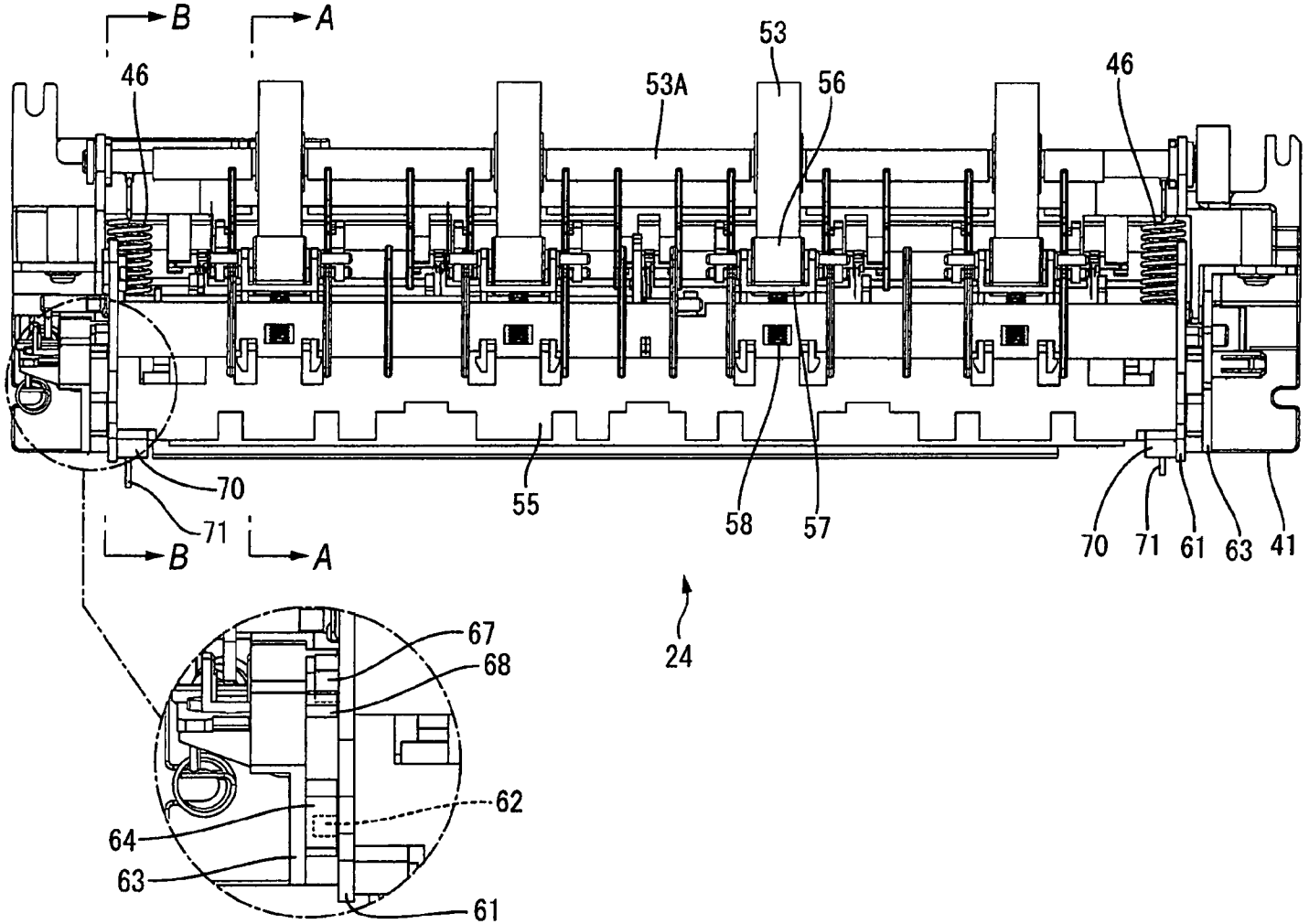
FIG. 2 is a rear view of a fixing unit with a fixing cover closed.
Figure 5:
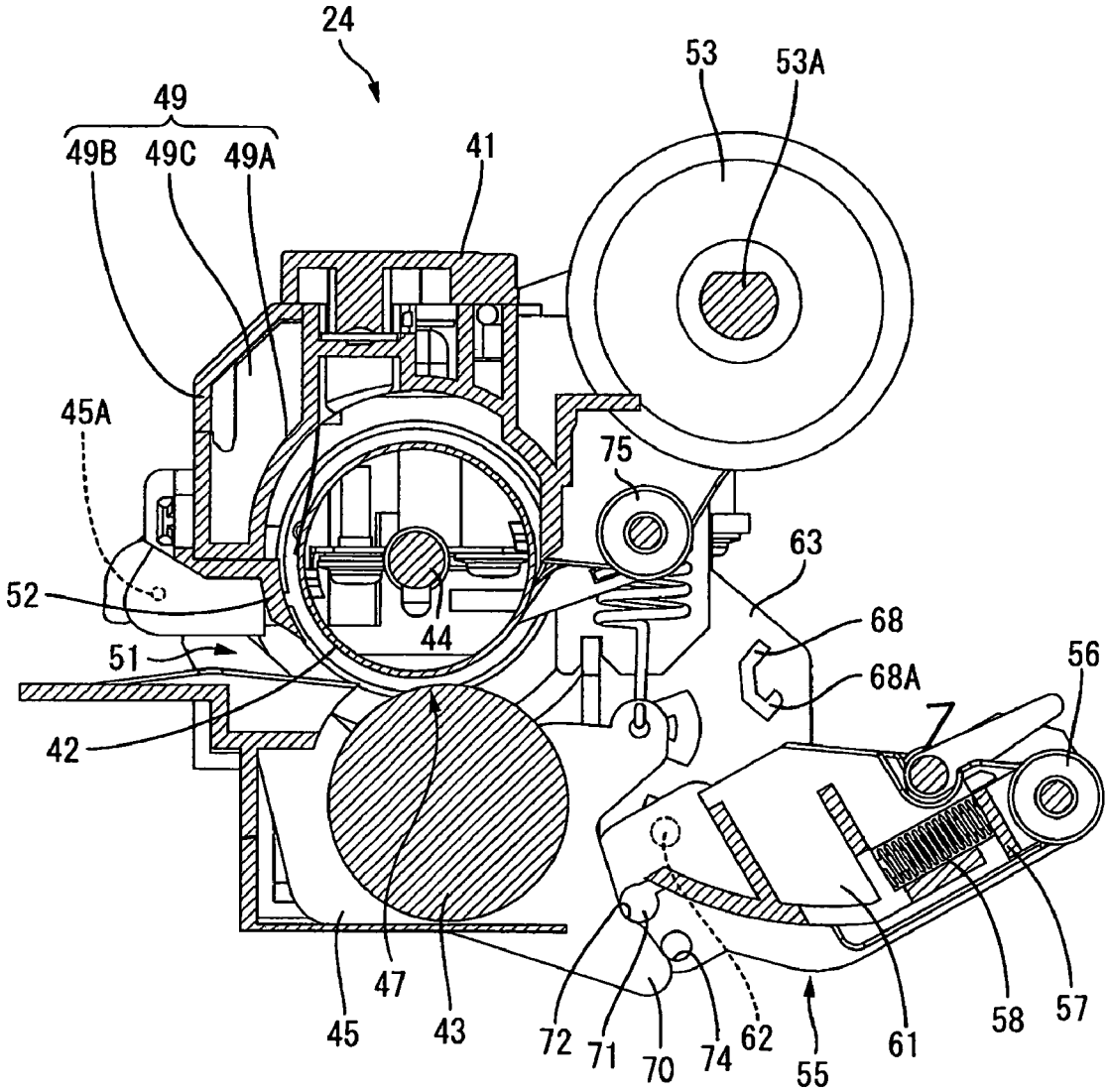
FIG. 5 is a sectional view taken along the line A-A in FIG. 2 with the fixing cover in a closed posture.
Figure 6:
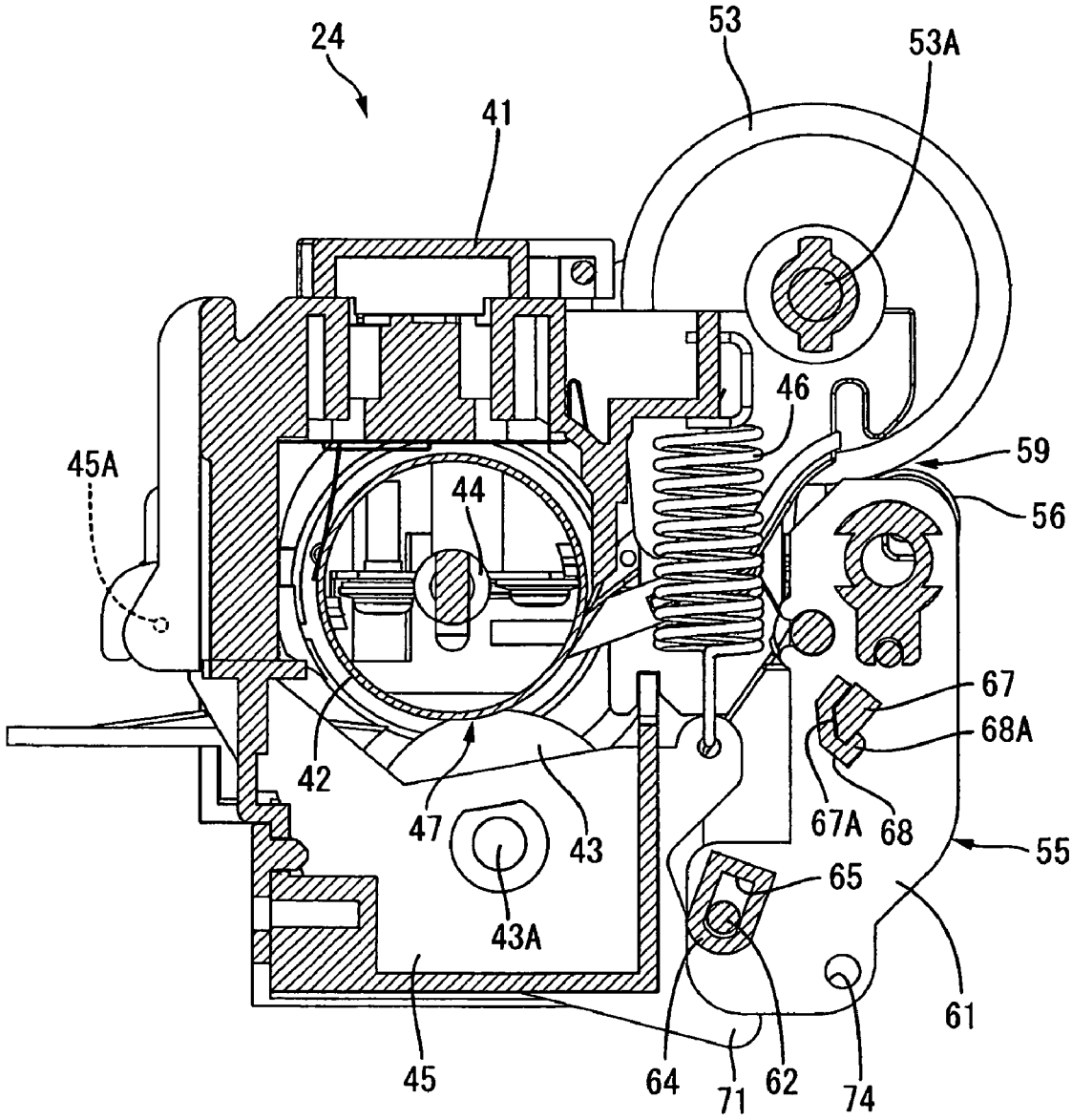
FIG. 6 is a sectional view taken along the line B-B in FIG. 2.

(4) Fixing Unit:

The construction of the fixing unit 24 will now be described in detail. FIG. 2 is a rear side view of the fixing unit 24 with a fixing cover 55 closed, FIG. 3 a sectional view taken along 5 the line A-A in FIG. 2, FIG. 4 a sectional view taken along the line A-A in FIG. 2, showing the way to the opening of the fixing cover 55, and FIG. 5 a sectional view taken along the line A-A in FIG. 2, showing the fixing cover 55 opened. FIG. 6 is a sectional view taken along the line B-B in FIG. 2, FIG. 7 a sectional view taken along the line B-B in FIG. 2, showing the way to the opening of the fixing cover 55, and FIG. 8 a sectional view taken along the line B-B in FIG. 2, showing the fixing cover 55 opened.

Figure 3:
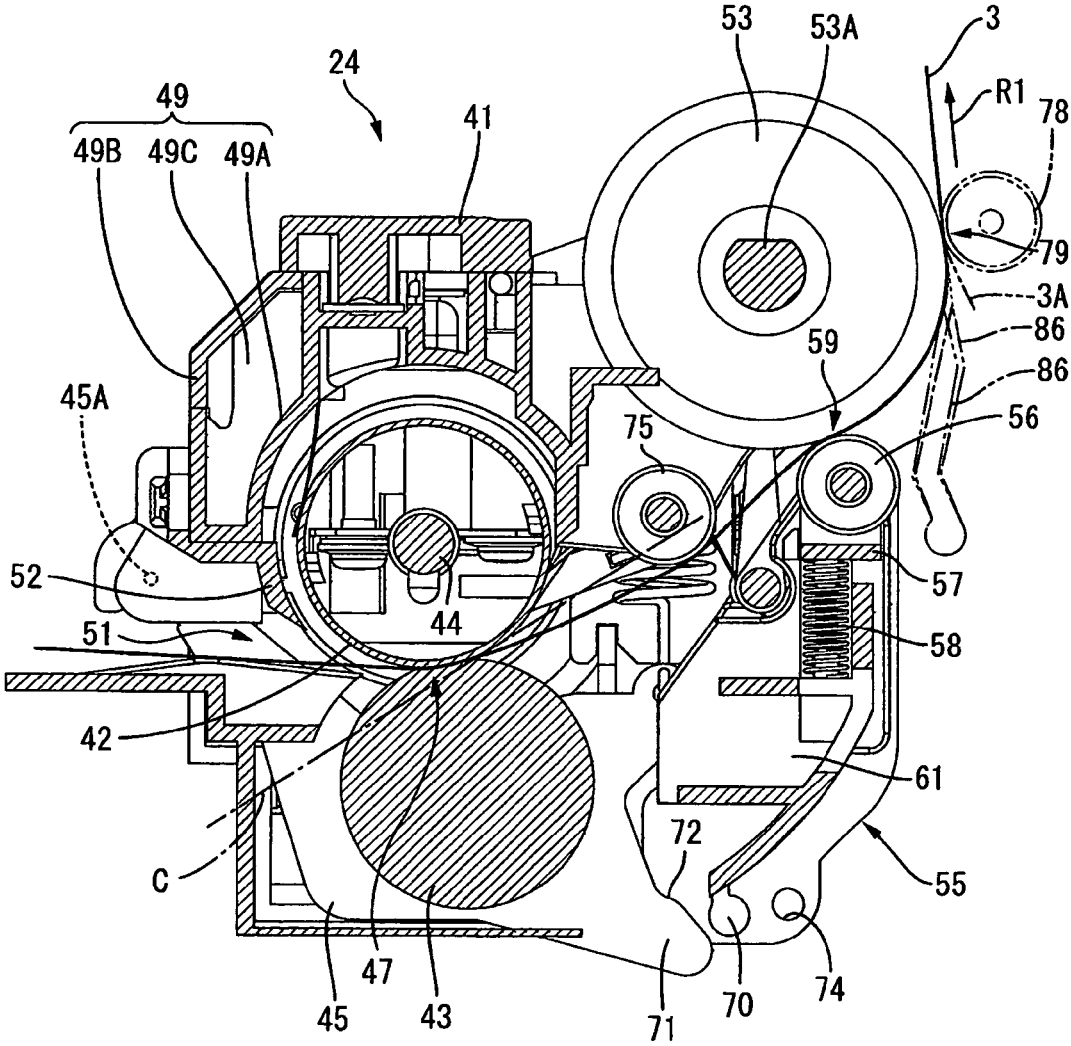
FIG. 3 is a sectional view taken along the line A-A in FIG. 2.

The fixing unit 24 is provided on the downstream (rear) side of the transfer position between the photosensitive drum 33 and transfer roller 27. As shown in FIG. 3, etc., this fixing unit 24 is provided with a fixing frame 41 as a case member. On the inner side of the fixing frame 41, the heating roller 42 and pressure roller 43 and the like are provided. The fixing frame 41 is formed out of a crystalline glass-reinforced resin and the like so as to generally cover the circumferences of the heating roller 42 and pressure roller 43.

The heating roller 42 is formed out of a metal, such as aluminum to a cylindrical shape, and a halogen lump 44 is provided in the interior thereof. This heating roller 42 is rotatably supported at both axial ends on the fixing frame 41. The heating roller 42 is rotated counter-clockwise in FIG. 3 owing to an input of power from a motor (not shown).

The pressure roller 43 is covered a metal roller shaft 43A thereof with a roller made of a rubber material as shown in FIG. 6, and both ends of the roller shaft 43A are fixed to flat arms 45, the pressure roller 43 being thereby supported so that the pressure roller can be rotated around the roller shaft 43A. Each arm 45 is supported on an arm shaft 45A provided in a position on the diagonally upper side of the roller shaft 43A of the pressure roller 43 so that the arm 45 is swung about this arm shaft 45A. Since both of the arms 45 are swung about the arm shaft 45A, the pressure roll 43 can be displaced toward and away from the heating roller 42. An upper end portion of a spring 46 elastically deformable in the vertical direction is fixed to an upper portion of a rear surface of the fixing frame 41, while a lower end of the spring 46 is fixed to a diagonally upper portion of the roller shaft 43A in the arm 45. Owing to this structure, the pressure roller 43 is brought into pressure contact with the heating roller 42 by an urging force of the spring 46, so that a fixing nip portion 47 is formed between the two rollers 42, 43.

The fixing frame 41 is provided as shown in FIG. 3 with a heat insulating wall portion 49 in the part of the fixing frame which covers upper to front portions of the heating roller 42. This heat insulating wall portion 49 has a double structure provided with an inner wall 49A and an outer wall 49B, between which a hollow 49C is provided. Since the heat insulating wall portion 49 provided with the hollow 49C for a heat insulating purpose is thus formed in the fixing frame 41, the discharging of heat due to the radiation and the like from the heating roller 42 to the outside of the fixing unit 24 can be suppressed. This enables a temperature rise in the apparatus to be suppressed, and a thermal loss of the heating roll 42 to be reduced. The heat insulating wall portion 49 in this aspect is molded hollow by gas injection molding. The method of forming this heat insulating wall portion 49 is not limited to this method. For example, a method of fixing a separately formed cover to the outer side of the fixing frame so as to provide a hollow therebetween, or a method of forming a hollow by the foam molding may be employed.

In a front surface of the fixing frame 41, a paper introducing port 51 for introducing the paper 3 into a front position of the fixing nip portion 47 of the fixing unit 24 is opened. A heat insulating cover 52 is extended out from a lower end of the heat insulating wall portion 49 to the inner side of the paper introduction port 51. Since this heat insulating cover 52 is curved so as to form a predetermined width of clearance between the heat insulating cover 52 and an outer circumferential surface of the heating roller 42, the heat insulating cover does not come into contact the outer circumferential surface of the heating roller 42. In addition, a free end of the heat insulating cover 52 is provided above a straight line (substantially agreeing with a position in which the paper 3 passes) connecting the fixing nip portion 47 and the transfer position between the photosensitive drum 33 and transfer roller 27 together, so that the heat insulating cover does not come into contact with the paper 3 entering the nip portion 47. Due to this heat insulating cover 52, the discharge of the radiation heat, etc., from the paper introduction port 51 in the forward direction due to the hearting roller 42 can be suppressed, and this enables a temperature rise in the apparatus to be inhibited On a rear upper portion of the fixing frame 41, a shaft 53A of a fixing paper discharge roller 53 is supported rotatably in the lateral direction as shown in FIGS. 2 and 3. The fixing paper discharge rollers 53 as driving rollers, driven at the shafts 53A thereof, are provided four in a spaced manner in the lengthwise direction with respect to the shaft 53A. Each fixing paper discharge roller 53 is driven at the shaft 53 thereof by the power from a motor (not shown), so that the shaft 53A is rotated forward (counter-clockwise in FIG. 3) or in the opposite direction (clockwise in FIG. 3).

Figure 8:
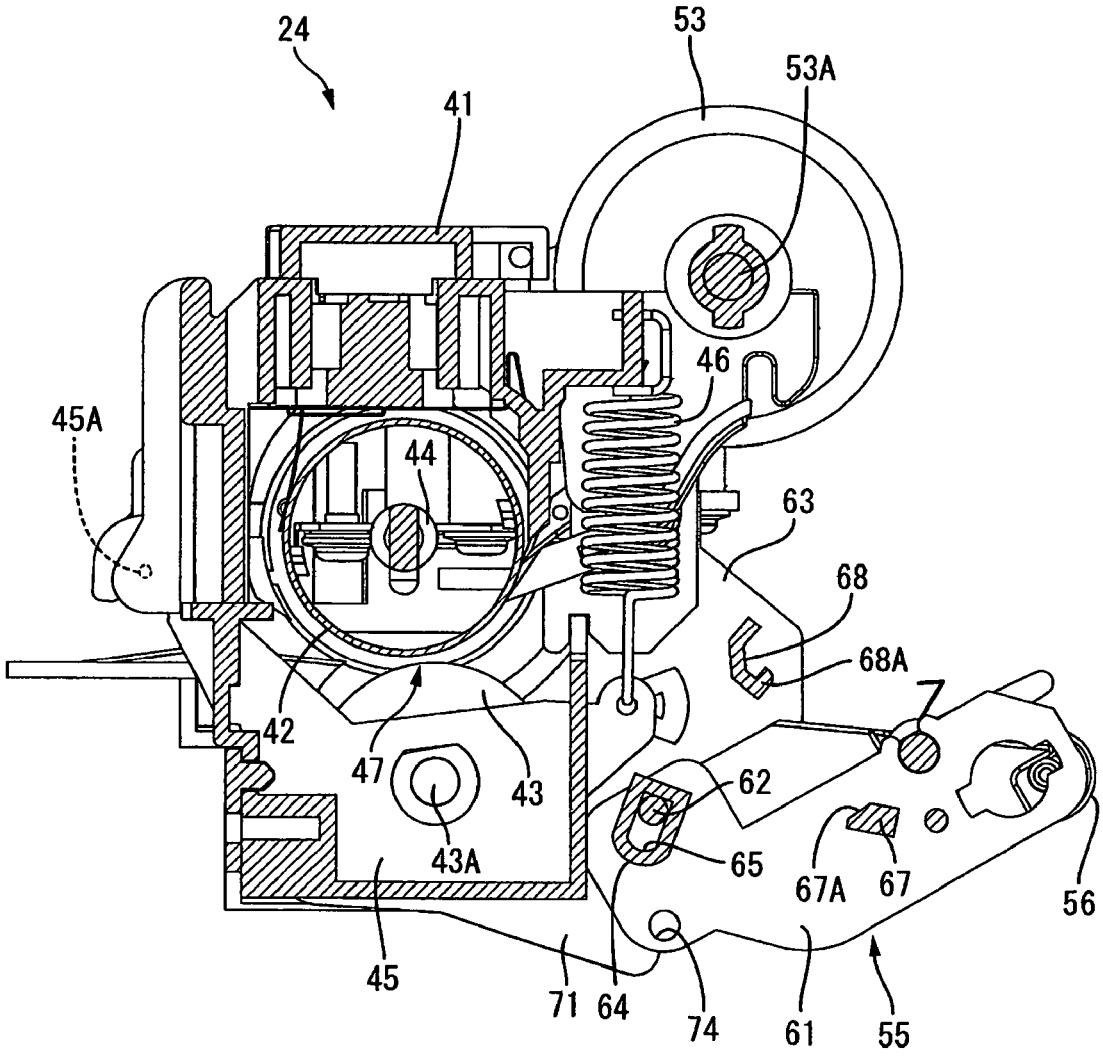
FIG. 8 is a sectional view taken along the line B-B in FIG. 2 showing the fixing cover in an opened posture.

On the rear surface of the fixing frame 41, a fixing cover 55 for enclosing the heating roller 42 and pressure roller 43 in cooperation with the fixing frame 41 is attached openably to a lower side of the fixing paper discharge roller 53. This fixing cover 55 can be retained as shown in FIGS. 3 and 6 in a vertical posture, i.e., in a closed posture for covering the rear side of the fixing nip portion 47, and in a posture as shown in FIGS. 5 and 8, i.e., in an opened posture for opening the rear side of the fixing nip portion 47 with the upper end portion in the closed posture is brought down rearward from the closed posture. A closed posture is basically referred to in the following description of the fixing cover 55 unless otherwise specified.

The fixing cover 55 as shown in FIGS. 2 and 3 is provided at the portion thereof which corresponds to the fixing paper discharge roller 53 with a first roller retainer 57 for retaining a first pinch roller 56 as a first driven roller. This first roller retainer 57 is capable of being displaced in the vertical direction, and urged upward by a roller urging spring 58. The first pinch roller 56 is kept driven rotatable so as to project upward from an upper end of the fixing cover 55. When the fixing cover 55 is in a closed posture, the first pinch roller 56 is in pressure contact with the lower outer circumferential surface of the fixing paper discharge roller 53 by an urging force of the roller urging spring 58 to form the first nip portion 59. This first nip portion 59 is positioned on the downstream side of and on the diagonally rear upper side of the fixing nip portion 47.

A pair of substantially vertically elongated side plates 61 are provided at the left and right side ends of the fixing cover 55 as shown in FIG. 2 and FIG. 6. Each side plate 61 is provided at the portion thereof which is near the lower end thereof and on the outer surface thereof with a columnar cover shaft 62 projecting outward which constitutes the center of the turning of the fixing cover 55. The fixing frame 41 is provided with left and right opposed walls 63 opposed to each other with a predetermined width of space left with respect to the side plates 61 of the fixing cover 55. Each opposed wall 63 is provided with an inwardly projecting cylindrical bearing 64, the cover shaft 62 being pivotably fitted in a slide groove 65 formed on the inner side of the bearing 64. The slide groove 65 extends substantially in the vertical direction (to be exact, in the rear end-rising diagonal direction). The fixing cover 55 is rendered slidable in the longitudinal direction of the slide groove 65 between the closed state retaining position (refer to FIG. 6) in which the cover shaft 62 is positioned in the lower end of the slide groove 65 and the opening and closing allowable position (refer to FIGS. 7 and 8)in which the cover shaft 62 is positioned in the upper end of the slide groove 65.

Each side plate 61 of the fixing cover 55 is provided on the portion thereof which is closer to the upper end than to the cover shaft 62 with a lock projection 67 projecting outward. This lock projection 67 has an elongated shape of a rectangular solid in the rear end-raised direction, a front end corner portion thereof being cut off to form a tapering surface 67A. Each of the opposed walls 63 of the fixing frame 41 is provided in the portion thereof which is diagonally rear upper portion of the bearing 64 with a portion 68 to be locked projecting inward. This portion 68 to be locked is substantially U-shaped and opened in the diagonally rear upward direction. When the lock projection 67 is moved in the longitudinal direction into the inner side of the portion 68 to be locked, both of projection 67 and portion 68 to be locked are engaged with each other, so that the turning of the fixing cover 55 in a closed posture around the cover shaft 62 to the opened posture is restricted. The lock projection 67 and the portion 68 to be locked is put in an engaged state when the fixing cover 55 is in a closed state-retaining position, and in a non-engaged state when the fixing cover 55 is in an opening and closing allowing position. When the fixing cover 55 is in a closed state retaining position, the elastic restoration force of the roller urging spring 58 for urging the first pinch roller 56 toward the fixing paper discharge roller 53 is exerted in the direction (downward direction) in which the elastic restoration force urges the fixing cover 55 acts from the opening and closing allowing position toward the closed state-retaining position. Namely, the roller urging spring 58 is capable of restricting the sliding of the fixing cover 55 from the closed state-retaining position to the opening and closing allowing position, and functions as a resetting action performable sliding restricting means. Since in this structure the fixing cover 55 is urged by its own weight from the closed state retaining position toward the opening and closing allowing position, the fixing cover 55 functions as a slide restriction means.

The fixing cover 55 is provided as shown in FIG. 2 and FIG. 3 in lower end positions on the inner surfaces of the left and right side plates 61 with substantially columnar release lock portions 70 extending in the lateral direction. The arm 45 mentioned above is provided with a portion 71 to be pressed extending in the diagonally rear lower direction with respect to the shaft 43A of the pressure roller 43. When the fixing cover 55 is in an opening action, the release lock portion 70 is engaged with a rear edge of the portion 71 to be pressed, to cause the arm portion 45 to be lowered. The portion 71 to be pressed is provided at the rear edge thereof with an arcuately depressed lock recess 72, which is engaged (refer to FIG. 5) with the release lock portion 70 when the portion 71 to be pressed lowers the arm 45 in a predetermined quantity.

The fixing cover 55 is provided on an upper portion of a rear surface thereof with a substantially vertical surface-carrying chute 69. This chute 69 constitutes a part of a re-transfer passage 84 as will be described later, on an outer surface of which a plurality of perpendicularly extending ribs 69A are provided in a projecting state for guiding the paper 3 smoothly. The lower end portion of the side plate 61 in the fixing cover 55 is provided with a shaft hole 74 in which an entry preventing cover 73 (refer to FIG. 9 and FIG. 10) which will be described later is fixed. FIG. 2 to FIG. 8 show the condition of the entry preventing cover 73 removed from the shaft hole 74 for the convenience of the description thereof.

As shown in FIG. 3, the fixing frame 41 has at the portion thereof which is in the middle position between the fixing nip portion 47 and first nip portion 59 a driven rotatable intermediate roller 75 as an intermediate driven roller, The intermediate roller 75 is disposed on the opposite side of the first pinch roller 56 with respect to the paper 3 transferred between the fixing nip portion 47 and first nip portion 59, and a contact point with respect to the paper 3 projects from the common tangent C of the heating roller 42 and first pinch roller 56 toward the first pinch roller 56.

Figure 9:
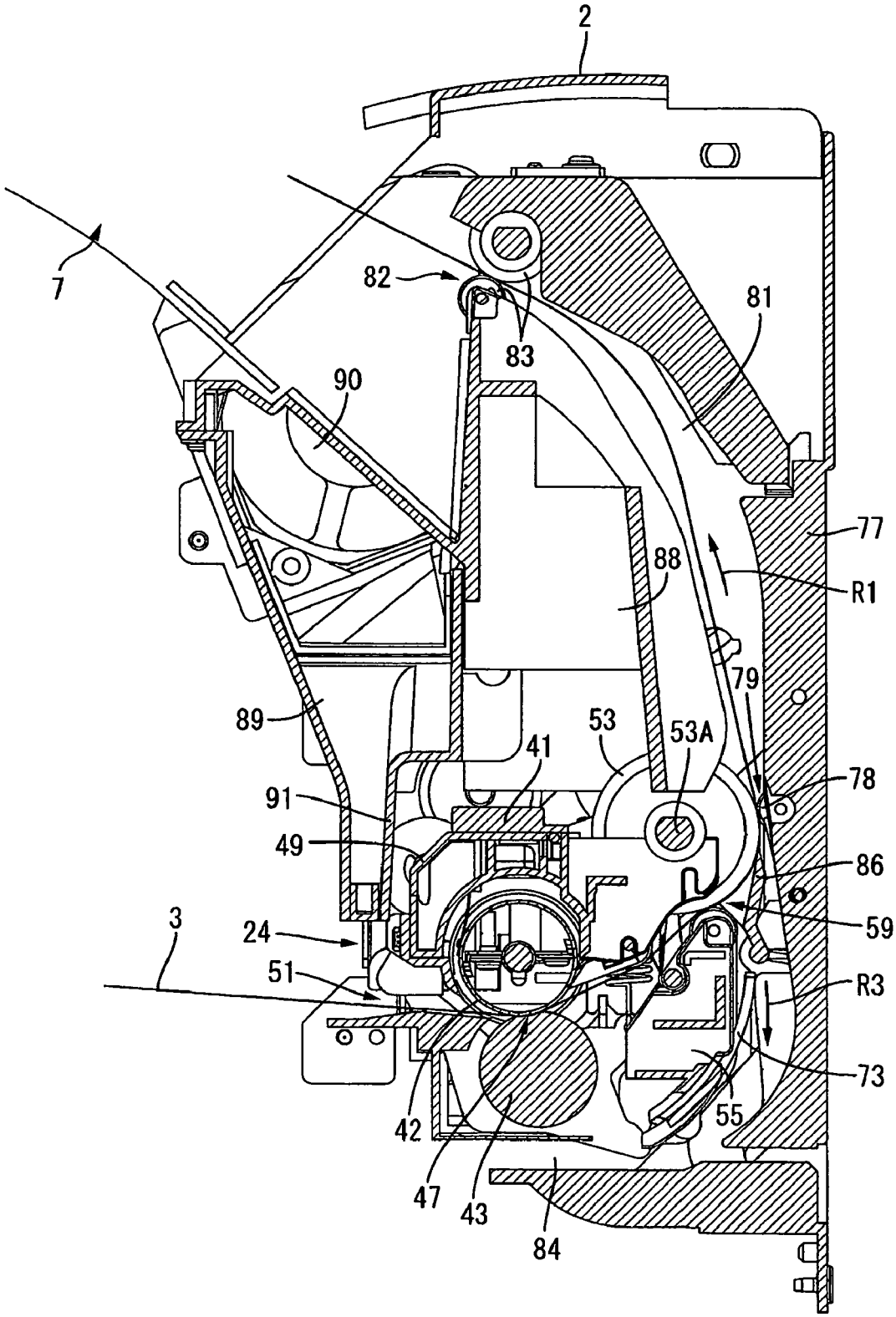
FIG. 9 is a sectional view showing a rear portion of the laser printer with the rear cover closed.
Figure 10:
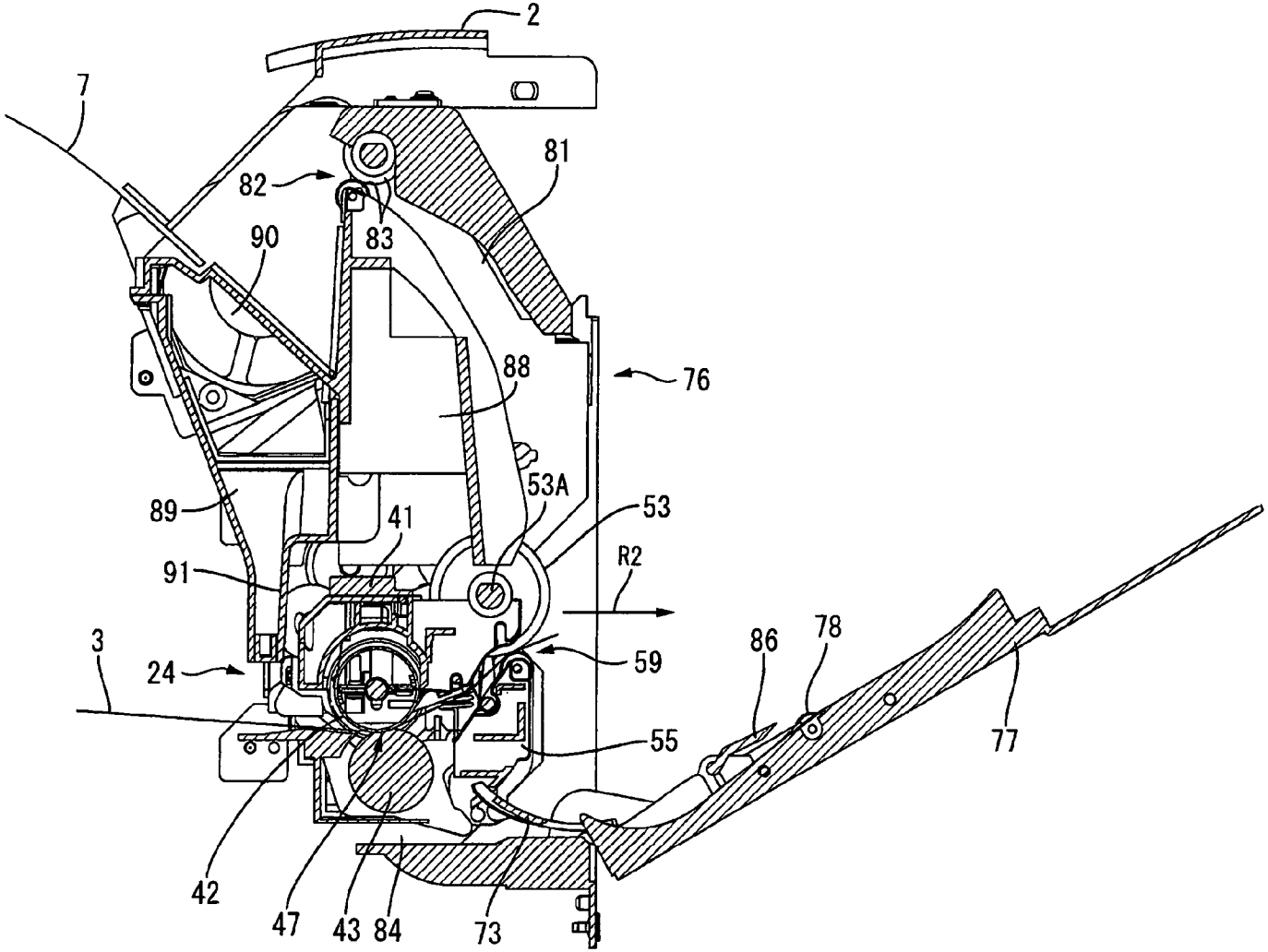
FIG. 10 is a sectional view showing the rear portion of the laser printer with the rear cover opened.

(5) Condition of Transfer Passage after Completion of Fixing Operation:

FIG. 9 is a sectional view showing a rear portion of a laser printer 1 with a rear cover 77 closed, and FIG. 10 a sectional view showing the rear portion of the laser printer 1 with the rear cover 77 opened.

A body casing 2 is provided with a rear side opening 76 at the back of the fixing unit 24, and a rear side cover 77 as a side cover for openably covering the rear side opening 76. The rear side cover 77 is capable of being turned around the portion thereof which is in the vicinity of a lower end thereof from a closed posture shown in FIG. 9 to an opened posture shown in FIG. 10. An inner surface of the rear cover 77 is provided in the portion thereof which corresponds to each fixing paper discharge roller 53 with a second roller retainer (not shown) for retaining a second pinch roller 78 as a driven rotatable second driven roller. The second roller retainer is set capable of being turned longitudinally, and urged forward by a spring (not shown) . When the rear cover 77 is closed, the second pinch roller 78 is engaged under pressure with the rear side of the fixing paper discharge roller 53 by the urging force of the spring (not shown) to form a second nip portion 79. This second nip portion 79 is positioned on the downstream side and on the diagonally rear upper side of the first nip portion 59.

A rear portion of the interior of the body casing 2 is provided with a substantially arcuately extending passage 81 is provided so that the passage 81 extends from the second nip portion 79 in the diagonally forward and upward direction, and a discharge port 82 is provided at the upper end of the arcuate passage 81. The discharge port 82 is provided with upper and lower upper paper discharge rollers 83, and the paper 3 sent from the arcuate passage 81 is discharged onto the paper discharge tray 7 by the upper paper discharge roller 83. In a lower portion of the interior of the body casing 2, a re-transfer passage 84 extending from the second nip portion 79 in the downward direction, and then forward is provided, as also shown in FIG. 1. In this re-transfer passage 84, relay rollers 85 for transferring the paper 3 to two positions. The re-transfer passage 84 is bent upward in a front portion of the body casing 2, and joined to a position immediately before the registration roller 16.

This laser printer 1 is formed so that the thermally fixed paper 3 is sent to one of the following three transfer passages. In this laser printer 1, a first transfer passage R1 (refer to FIG. 9) extending from the second nip portion 79 to the paper discharge tray 7 through the arcuate passage 81 with the rear cover 77 closed, a second transfer passage R2 (refer to FIG. 10) extending from the first nip portion 59 to the upper portion of the rear cover 77 with the rear cover 77 opened, and a third transfer passage R3 (refer to FIG. 9) extending from the second nip portion 79 to the image forming member 5 again through the re-transfer passage 84 with the rear cover 77 closed.

A flapper 86 as a pivotable transfer passage shift member is fixed to the portion of the rear cover 77 which is below the second pinch roller 78. The flapper 86 has a plate type cross-sectionally sharpened free end portion, and, when the rear cover 77 is closed, the free end portion is disposed in an intermediate position between the first nip portion 59 and second nip portion 79. The flapper 86 is as shown in FIG. 3 as well a free end portion thereof is capable of being displaced to a reverse direction guide position (two-dot chain line) in which a free end portion thereof contacts an outer circumferential surface of the fixing paper discharge roller 53, and a forward direction guide position (one-dot chain line) in which the free end portion thereof leaves from the outer circumferential surface of the fixing paper discharge roller 53. Since the flapper 86 is urged counter-clockwise in FIG. 3 by a spring, the free end portion thereof is urged against the outer circumferential surface of the fixing paper discharge roller 53.

Below the flapper 86, a part of the re-transfer passage 84 (third transfer passage R3 is formed between the chute portion 69 of the fixing cover 55 and the inner surface of the rear cover 77. Below the chute portion 69, the entry preventing cover 73 is provided. This entry preventing cover 73 is like an arcuately curved plate, and a shaft portion (not shown) provided in the vicinity of a lower end thereof is engaged with the shaft hole 74, the entry preventing cover being thereby fixed thereto so that the entry preventing cover can be turned around the shaft hole 74. When the rear cover 77 is closed, the rib 87 projecting from the inner surface of the rear cover 77 is engaged with the side end portion of the entry preventing cover 73 as shown in FIG. 9, and the entry preventing cover 73 is supported in a shunting position in which the entry preventing cover 73 is in a standing posture. In this shunting position, a part of the re-transfer passage 84 (third transfer passage R3) is formed between the outer surface of the entry preventing cover 73 and the inner surface of the rear cover 77 is formed, and the entry preventing cover is held in the position in which the entry preventing cover does not interrupt the re-transfer passage 84. When the rear cover 77 is opened, the entry preventing cover 73 is supported in an entry preventing position in which the entry preventing cover 73 is brought down to the rear side as shown in FIG. 10. In this entry preventing position, the entry preventing cover 73 closes the clearance between the rear cover 77 and fixing unit 24, so that the entry of the paper 3 into the re-transfer passage 84 is prevented.

The body casing 2 is provided in the rear portion of the interior thereof with an air flow passage 88 extending upward from the fixing unit 24. An upper portion of this air flow passage 88 communicates with the arcuate passage 81 and discharge port 82, and the air around the fixing unit 24 which is warmed with the radiation of heat from the upper portion of the fixing frame 41 is guided upward through this air flow passage 88 and discharged from the discharge port 82 to the outside. Between the air flow passage 88 and process cartridge 23 and scanner 22 which are on the most down stream side, a substantially vertically extending duct 89 is provided. A fan 90 is further provided in an upper left end position of an upper end portion of the duct 89. The outside air taken by this fan 90 is discharged from the duct 89 to the interior of the body casing 2, so that the interior of the body casing 2 is cooled. A partition 91 provided between the duct 89 and air flow passage 88 generally extends in the vertical direction, and a lower portion is projects forward in a stepped manner so as to shunt the fixing frame 41. Assuming that the duct is formed so as to cover the upper portion of the fixing unit, there is the possibility that the air in the duct is heated with the heat from the fixing unit to adversely affect the cooling function thereof. In this mode of embodiment, the upper portion of the fixing unit 24 forms the air flow passage 88 for discharging the air to the outside, so that the air in the duct 89 prevents from being heated with the radiation of heat from the fixing unit 24 to cause the cooling efficiency of the unit to be improved.

(6) Action, Operation and Effect of Laser Printer:

During an action of the laser printer, the paper 3 is transferred from a the fixing nip portion 47 to the first nip portion 59 owing to the forward rotation (counter-clockwise rotation in FIG. 3) of the heating roller 42 and fixing discharge roller 53. During this time, the paper 3 contacts the portion of the intermediate roller 75 which is between the fixing nip portion 47 and first nip portion 59, so that the paper is bent so as to project toward the first pinch roller 56. Therefore, as compared with a case where the intermediate roller 75 is not provided, the quantity of winding of the paper 3 around the first pinch roller 56 increases. When the paper 3 passes through the fixing nip portion 47, curl (bend) toward the heating roller 42 occurs in some cases. However, since the paper 3 is bent in the opposite direction along the outer circumferential surface of the first pinch roller 56 as mentioned above, the curl is corrected.

In order to face-down discharging of the paper after the printing thereof finishes, the printing is done with the rear cover 77 closed. As shown in FIG. 3 and FIG. 9, the free end of the paper 3 passed through the first nip portion 59 impinges upon the front surface of the flapper 86 (two-dot chain line in FIG. 3) in the opposite guide position to cause the flapper 86 to be displaced to the forward direction guide position (one-dot chain line in FIG. 3). The free end of the paper 3 advances toward the second nip portion 79 through the clearance opened between the free end of the flapper 86 and the outer circumferential surface of the fixing paper discharge roller 53. The paper 3 is then discharged from the second nip portion 79 onto the paper discharge tray 7 (first transfer passage R) through the arcuate passage 81 and discharge port 82, so that the paper is loaded on the tray 7 with the surface thereof printed in the image forming unit 5 directed downward.

In order to then print both surfaces of the paper 3, the printing action is carried out with the rear cover 77 closed as well. After one surface of the paper 3 is first printed in the image forming unit 5, the free end of the paper 3 is sent out into the arcuate passage 81 through the first nip portion 59 and second nip portion 79 in the same manner as in the face-down paper discharging operation. When the rear end of the paper 3 passed between the space between the flapper 86 and fixing paper discharging roller 53, the flapper 86 is displaced to a reverse direction guide position (two-dot chain line in FIG. 3) contacting the fixing paper discharge roller 53 by the urging force of the spring. Before the rear end 3A (refer to FIG. 3) of the paper 3 passes through the second nip portion 79, the fixing paper discharge roller 53 is rotated reversely (clockwise in FIG. 3) . As a result, the rear end 3A of the paper 3 moves down to contact the rear surface of the flapper 86, and the paper 3 is guided to the re-transfer passage 84 (third transfer passage R3). The rear end 3A of the paper 3 in the re-transfer passage 84 reaches the image forming unit 5 again through the registration roller 16, on which the printing is done on the surface opposite to the surface previously printed.

In order to carrying out the face-up discharging of the paper, the printing is done with the rear cover 77 opened, as shown in FIG. 10, When the rear cover 77 is opened, the second pinch roller 78 and flapper 86 leave the fixing paper discharge roller 53 to cause the second nip portion 79 to be opened. As a result, the paper 3 passed through the first nip portion 59 does not move toward the first transfer passage R1 but advances rearward as it is. The paper is discharged onto the rear cover 77 (second transfer passage R2) and loaded with the surface to be printed directed upward. When the rear cover 77 is opened, the entry preventing cover 73 falls outward due to its own weight, and the re-transfer passage 84 is closed. This prevents the paper 3 loaded on the rear cover 77 from sliding into the re-transfer passage 84.

Figure 4:
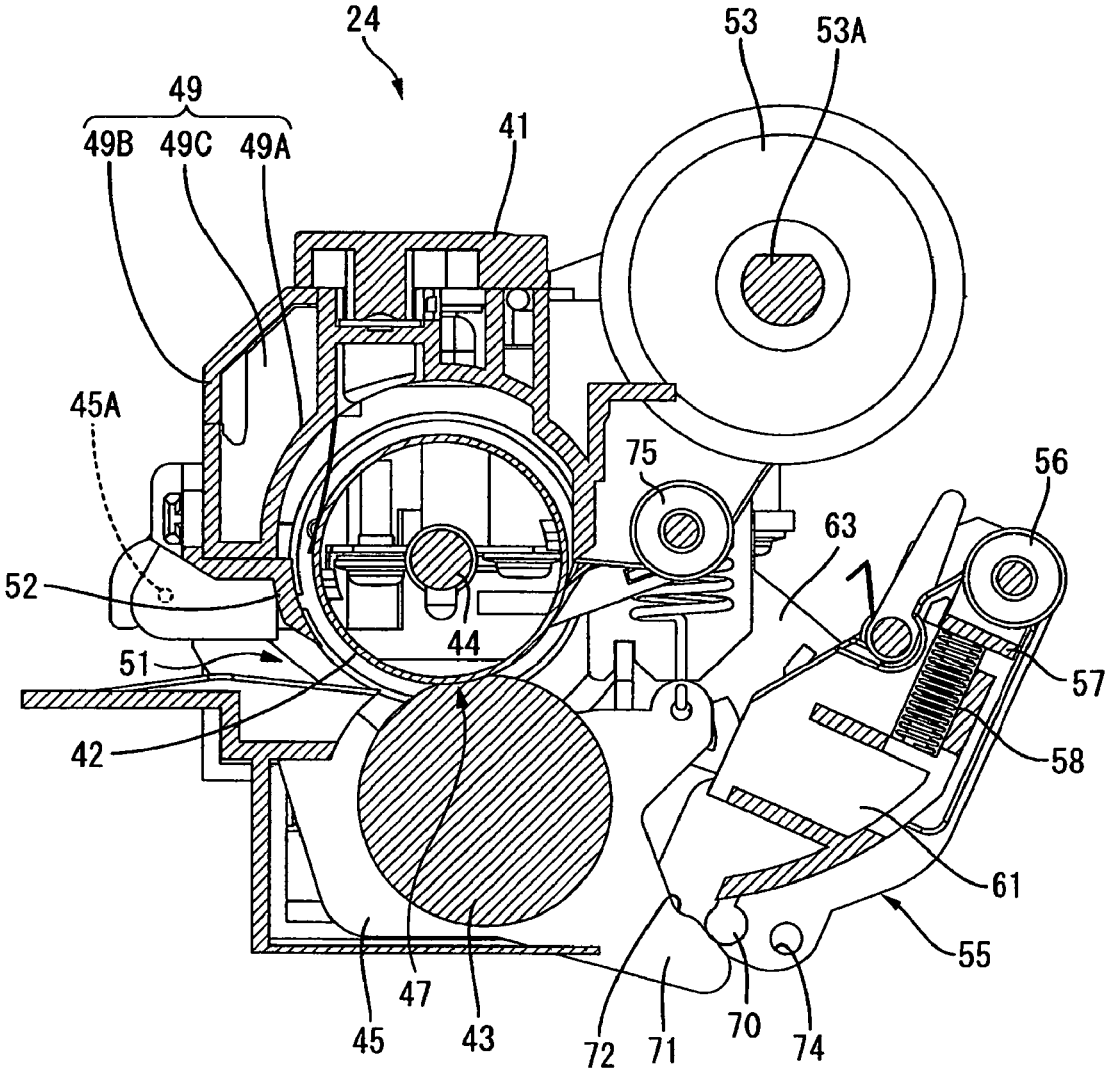
FIG. 4 is a sectional view taken along the line A-A in FIG. 2 showing the midst of a fixing cover opening operation.
Figure 7:
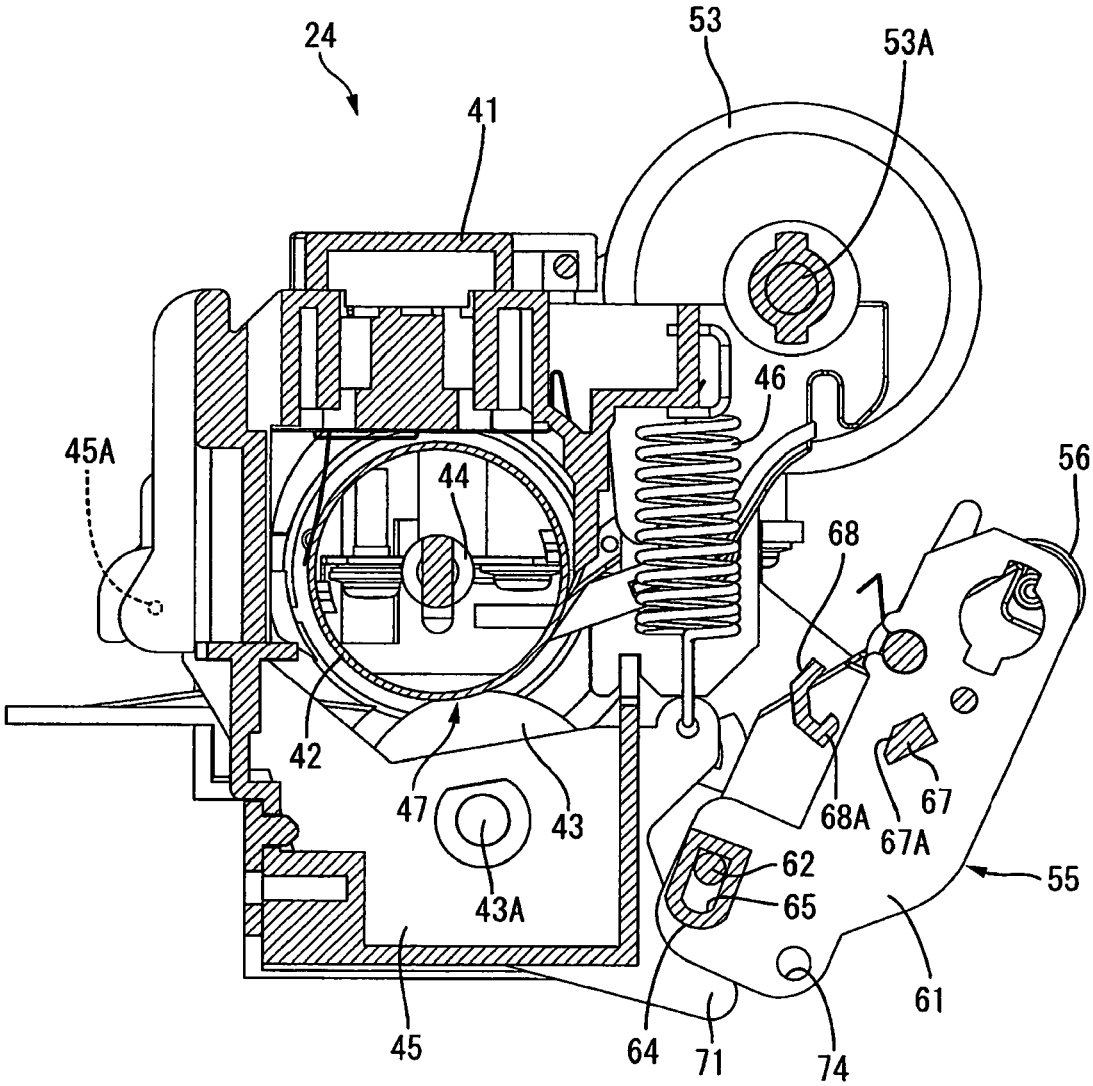
FIG. 7 is a sectional view taken along the line B-B in FIG. 2 showing the midst of the fixing cover opening operation.

In order to open the fixing cover 55 for the fixing unit 24, the rear cover 77 is first opened, and the fixing cover 55 in the closed state retaining position shown in FIGS. 3 and 6 is slid diagonally upward along the slide groove 65. During this time, the first roller retainer 57 on which the first pinch roller 56 is held is displaced downward with respect to the fixing cover 55, and the roller-carrying urging spring 58 is compressed. When the fixing cover 55 reaches the opening and closing allowing position, the cover shaft 62 reaches the substantially upper end of the slide groove 65, so that the engagement of the lock projection 67 and the member to be locked 68 with each other is released. When fixing cover 55 is then turned so as to fall the same cover rearward, the opening lock 70 engages the rear edge of the member 71 to be pressed of the lock 70, as shown in FIGS. 4 and 7. When the fixing cover 55 in this condition is further turned, the member 71 to be pressed is moved down, and the pressure roller 43 leaves the heating roller 42 to cause the fixing nip portion 47 to be opened. When the fixing cover 55 reaches the position of the opened state thereof shown in FIGS. 5 and 8, the opening lock 70 is engaged with the lock recess 72 of the member 71, so that the displacement of the arm 45 and fixing cover 55 is restricted. When in this condition the arm 45 tries to be turned counter-clockwise by the urging force of the spring 46, a component for turning the fixing cover 55 counter-clockwise around the cover shaft 62 does not work due to the positional relation between the cover shaft 62 and the opening lock 70 and lock recess 72, so that both the first nip portion 59 and fixing nip portion 47 are kept open. This enables a jam processing operation and the like to be carried out easily.

In order to close the fixing cover 55 in an opened posture shown in FIG. 5 and FIG. 8, the fixing cover 55 is pressed in the diagonally forwardly upward direction and turned counter-clockwise, so that the opened lock 70 and lock recess 72 are disengaged from each other, whereby the arm 45 moves upward by an urging force of the spring 46 and the pressure roller 43 urges the heating roller 42. As a result, a tapering surface 67A of the lock projection 67 engages with a lower side portion 68A of the portion 68 to be locked, and the lock projection 67 runs on the lower side 68A. In the meantime, the first pinch roller 56 comes into contact with the fixing paper discharge roller 53 to cause the roller urging spring 58 to be compressed. When the fixing cover 55 attains a closed posture, the lock projection 67 runs on the lower side 68A of the portion 68 to be locked, and the fixing cover 55 slides from the opening and closing allowing position to the closure retaining position owing to the elastic restoration force of the roller urging spring 58 with the lock projection 67 being engaged (refer to FIGS. 3 and 6) with the inner side of the portion 68 to be locked 68.

Since the fixing cover 55 is thus urged from the opening and closing allowing position toward the closure retaining position owing to the roller urging spring 58, the sliding of the fixing cover 55 to the opening and closing allowing position is restricted, so that the inadvertent opening of the fixing cover 55 can be reliably prevented.

According to this aspect, the paper 3 can be sent selectively into the three transfer passages R1 to R3 by one driving roller (fixing paper discharge roller 53) and two driven roller (first pinch roller 56 and second pinch roller 78. Owing to this structure, one driving roller mechanism meets the purpose, and the complication of the apparatus can be prevented. Therefore, an increase in the dimensions of the apparatus and cost thereof can be prevented.

Since the third transfer passage R3 is formed of the re-transfer passage 84 for double-face printing, the selective sending of the paper into the re-transfer passage 84 and the other two transfer passages R1, R2 can be attained by a simple structure.

Since the first transfer passage R1 is used for a face-down paper discharging operation with the second transfer passage R2 for a face-up paper discharging operation, the selective sending of paper for the face-down and face-up paper discharging operations can be done by a simple structure.

Since the flapper 86 is provided between the first nip portion 59 and second nip portion 79, the transfer of the paper 3 can be carried out more smoothly.

The rear cover 77 is utilized as a tray for stacking the paper 3 transferred along the second transfer passage R2. Therefore, when the rear cover 77 is not in use, the rear cover 77 is closed, and this renders the apparatus compact.

The second pinch roller 78 is fixed to the rear cover 77. Therefore, when the rear cover 77 is opened, the second pinch roller 78 leaves the fixing paper discharge roller 53, and the second nip portion 79 is opened. This enables the selectively sending of the paper 3 into the first transfer passage R1 and second transfer passage R2 to be done simply.

When a curl bent toward the heating roller 42 occurs on the paper 3 in the fixing nip portion 47, the paper 3 is wound around the outer circumference of the first pinch roller 56 and bent back in the direction opposite to that of the curl extends, so that the curl is corrected. The intermediate roller 75 is rotated following the paper 3 transferred. Therefore, as compared with a case where the paper 3 is wound around the first pinch roller 56 by using a member other than a roller, the surface to be printed is rubbed less, so that the toner is rarely deposited thereon. This enables the occurrence of splot and jam on the paper 3 to be prevented.

Figure 11:
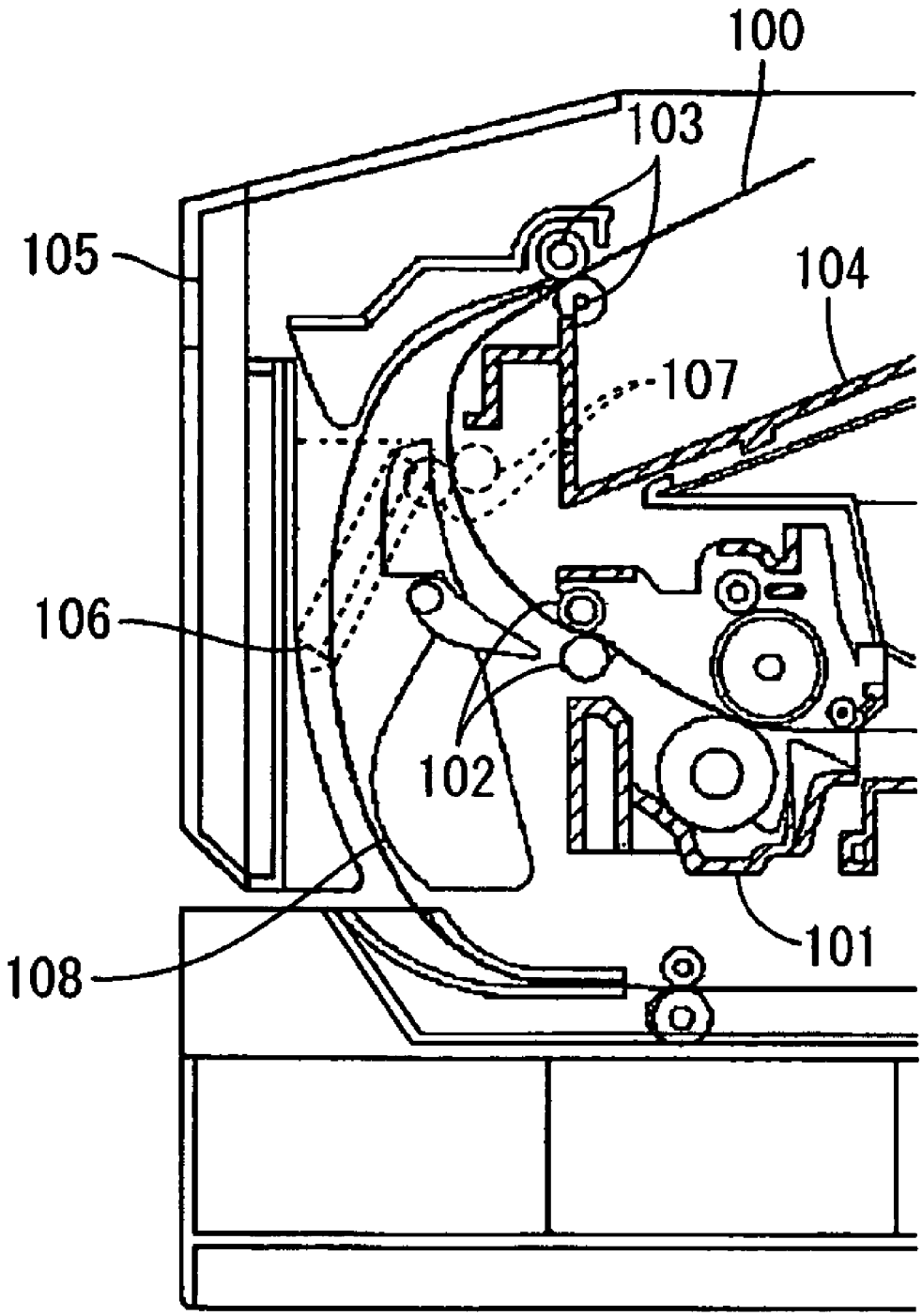
FIG. 11 is a sectional view showing a part of a related art laser printer.

The fixing cover 55 of the fixing unit 24 is provided with the chute 69 for guiding the paper 3 transferred along the re-transfer passage 84 (third transfer passage R3). Therefore, as compared with the related art apparatus (refer to FIG. 11) in which the chute 108 of a separate member is provided between the fixing unit 101 and re-transfer passage 106, the apparatus can be miniaturized, and the cost of the parts can be reduced.

The present invention is not limited to the aspect described above and illustrated in the drawings but can be practiced by modifying the aspect variously within the scope not departing the gist of the invention.

What is claimed is:

1. An image forming apparatus comprising:

an image forming unit that forms an image on a sheet;

a driving roller that is provided on a downstream side of the image forming unit and rotates in forward and reverse directions;

a first driven roller that is driven to rotate and forms a first nip portion in cooperation with the driving roller;

a second driven roller that is driven to rotate and forms a second nip portion in cooperation with the driving roller, the second driven roller being provided on a downstream side of the first nip portion;

a first transfer passage into which the sheet passed through the first nip portion and sent from the second nip portion is transferred by a forward rotation of the driving roller;

a second transfer passage into which the sheet passed through the first nip portion is transferred by the forward rotation of the driving roller without passing through the second nip portion; and a third transfer passage into which the sheet passed through the first nip portion and nipped at the second nip portion is transferred by a reverse rotation of the driving roller after a rear end of the sheet has passed through the first nip portion by the forward rotation of the driving roller.

2. The image forming apparatus according to claim 1, wherein the third transfer passage is formed as a re-transfer passage for retransferring the sheet on one surface of which the image has formed by the image forming unit to the image forming unit again with the sheet being upside-down.

3. The image forming apparatus according to claim 1, wherein the first transfer passage is configured to transfer the sheet on one surface of which the image has formed by the image forming unit to a first tray on which the sheet is stacked with an image-formed surface thereof directed downward; and wherein the second transfer passage is configured to transfer the sheet on one surface of which the image has formed by the image forming unit to a second tray on which the sheet is stacked with the image-formed surface thereof directed upward.

4. The image forming apparatus according to claim 1, further comprising a transfer passage shifting member provided between the first nip portion and the second nip portion around the driving roller, the transfer passage shifting member being displaceable to a forward direction guide position at which the sheet sent from the first nip portion is guided to the second nip portion and a reverse direction guide position at which the sheet sent from the second nip portion is guided to the third transfer passage.

5. The image forming apparatus according to claim 1, further comprising a cover that covers a side portion of the image forming apparatus on the downstream side of the first nip portion, the cover capable of being opened and closed and capable of stacking thereon the sheet transferred along the second transfer passage when the cover is opened.

6. The image forming apparatus according to claim 5, wherein the second driven roller is attached to the cover.

7. The image forming apparatus according to claim 1, wherein the image forming unit comprises:

a heating roller that rotates while heating the sheet; and a pressure roller that forms a fixing nip portion in cooperation with the heating roller and urges the sheet passing through the fixing nip portion against the heating roller; and wherein the image forming apparatus further comprising an intermediate driven roller provided between the fixing nip portion and the first nip portion and on an opposite side of the first driven roller with respect to the sheet, the intermediate driven roller being driven to rotate while being in contact with the sheet in a position projected from a common tangent line of the heating roller and first driven roller toward the first driven roller than.

8. The image forming apparatus according to claim 1, wherein the image forming unit comprises:

a heating roller that rotates while heating the sheet;

a pressure roller that forms a fixing nip portion in cooperation with the heating roller and urges the sheet passing through the fixing nip portion against the heating roller; and a fixing unit having a case body covering the heating roller and the pressure roller; and wherein the case body comprises a chute configured to guide the sheet transferred along the third transfer passage.

* * * * *